United States Patent [19]

Sievers

[11] Patent Number: 4,557,218

[45] Date of Patent: Dec. 10, 1985

[54] DEVICE FOR CONTINUOUS APPLICATION OF FOAM ONTO A FLAT STRUCTURE

[75] Inventor: Erich Sievers, Bremen, Fed. Rep. of Germany

[73] Assignee: Manfred Kupfer, Gross Ippener, Fed. Rep. of Germany

[21] Appl. No.: 612,353

[22] Filed: May 21, 1984

[30] Foreign Application Priority Data

May 21, 1983 [DE] Fed. Rep. of Germany ..... 3318711

[51] Int. Cl.[4] ..... B05C 5/02

[52] U.S. Cl. ..... 118/612; 68/200; 118/410; 118/415

[58] Field of Search ..... 118/612, 410, 415, 419; 264/56; 261/DIG. 26; 425/4 C; 68/200, 205 R

[56] References Cited

U.S. PATENT DOCUMENTS 3,377,139 4/1968 MacGregor et al. ..... 261/DIG. 26
4,061,001 12/1977 Vondeveltz et al. ..... 118/612 X
4,297,860 11/1981 Pacifici et al. ..... 68/200

*Primary Examiner*—John P. McIntosh
*Attorney, Agent, or Firm*—Collard, Roe & Galgano

[57] ABSTRACT

In a device for the continuous application of foam onto a flat structure to be coated there is provided a cylindrical container which is implemented as a foaming device wherein a rotating shaft is supported, which carries foaming elements formed as apertured disks. The foam is discharged directly from a slit-like opening in the lower portion of the cylindrical container to the structure to be coated.

25 Claims, 6 Drawing Figures

DEVICE FOR CONTINUOUS APPLICATION OF FOAM ONTO A FLAT STRUCTURE

The present invention relates to a device for applying foam which is continuously manufactured from flowable and foamable material to a flat structure to be coated thereby. Such structure may, for example, be a track-shaped textile material. The device includes a container disposed directly above the flat structure passing therebelow and is formed on its underside facing the structure with a slit-like opening having a length corresponding to the desired coating width. The container is implemented as a foaming device wherein supply conduits communicate with the container to pass a foamable material and working gas thereto.

Devices of the above-described type are particularly used in the upgrading of textiles, for example, for coating of carpets or coloring of track-shaped textile materials. Foam coating is also used in the paper industry, for example, during the manufacture of wallpaper. The always freshly produced foam is applied by means of a coating device, the foam being produced in a separate foaming apparatus and supplied to the coating apparatus by means of a conduit, for example, a hose or tubular conduit.

Because it is necessary to provide both a plant for producing foam which can be readily applied and a coating device for coating the foam onto a flat structure, the employment of such devices is cost intensive and requires a high degree of investment. The foaming device requires complex controls, so that the quality and amount of the continuously produced foam does not deviate. Furthermore, the operation of the coating apparatus must be continuously controlled, since difficulties can arise by reason of the parameters responsible for operation of the foaming device influencing corresponding parameters of the coating device, and vice versa.

The unavoidable delay resulting from a post-control regulation of the foaming apparatus has been found to be particularly disadvantageous. Any deviation of the desired foam quality or quantity can be determined by an observer only within the actual coating region. Before necessary post-control adjustment or regulation of the foaming apparatus can be accomplished, the foaming device has produced a not inconsiderable amount of defective foam and supplied it to the container of the coating device. The effect of any subsequent control can only be observed in the application region of the coating device after the foam has already passed through the container. A solution to this problem by remote control has been attempted wherein the control is operated from the observation post associated with the coating apparatus for the foaming device. However, this feature requires a considerable constructional expense and does not avoid the resultant delay. This feature merely accelerates the post-control regulation itself since it is no longer necessary for the observing operator to leave the observation post for a post-regulation of the foaming apparatus.

U.S. Pat. No. 4,297,860, to Pacifici et al., granted Nov. 3, 1981, describes a device in which the foaming apparatus forms a constructional unit with the coating device, so as to be integral therewith. A separate provision of a foaming apparatus can therefore be dispensed with, so that the construction expense for the complete device is reduced. The discharge opening, through which the finally fabricated foam is discharged from the foaming apparatus, is positioned practically adjacent to the coating location. Thus, deviations concerning quantity of foam observed during operation of the device can be post-regulated without significant delays. Supply conduits communicate with the container for supplying a mixture of foamable material and driving gas.

The prior art device described in U.S. Pat. No. 4,297,860 has a disadvantage however, in that the quality of foam can only be regulated by controlling the supply of working gas and the medium to be foamed. Interruptions in the discharge of the generated foam frequently take place. This disadvantage occurs because the foam device operates as a so-called "static mixer", which effects the foaming process solely by dedicated, installed and rigid foaming elements. It is a further disadvantage of this device that its operation is limited to materials which may be statically foamed or which during static foaming furnish a foam quality which is adequate. Thus, materials which are relatively hard to foam, cannot be foamed or can be only inadequately foamed by means of such "static mixers".

It is, therefore, an object of the present invention to improve the known apparatus relating to the foaming operation and its application.

This object has been accomplished by the present invention by providing mechanically operating foaming elements in the container of such apparatus.

Foaming devices having mechanically operated foaming elements are advantageously suitable for the continuous manufacture of foams and for materials which can be foamed only with difficulty. Working gas, for example, air, is worked into the coating products, so that foam arises. Both the quantity of the foaming products, as well as the air, can be controlled. The mechanically added air is decisive for the degree of foaming, and consequently for the concentration and viscosity of the foam. As a result, the quality of the continuously manufactured foam is also dependent on the mechanical operation of the foaming elements.

Containers and foaming elements may be constructed with respective arbitrary shapes advantageously tailored to one another. In an advantageous further development, the container has a cylindrical form and includes a concentrically disposed driven shaft, in which the foaming elements are disposed. The cylindrical form of the container allows for simple manufacture and has the further advantage that it can easily withstand the operating pressure of several bars arising in the apparatus. A bar being equal to $10^6$ dynes per square centimeter. This cylindrical form also permits a simplified construction of the shaft. The shaft can, for example, be prefabricated with foaming elements, the installation of which into the cylindrical container thereby being facilitated.

In known mechanically operating foaming devices, there are provided meshing fingers, or the like, carried by rotating shafts. The effort involved in securing and aligning a multiplicity of such shafts is not inconsiderable.

The present invention differs from such prior art devices by each foaming element being formed of an apertured disk having an arbitrary arrangement of apertures, and rotating with the shaft. The disks can be disposed behind one another on the shaft in an arbitrary number. All the disks mounted on the shaft may have the same shape of apertures. But it is also possible to vary the apertures within a disk, or to dispose disks having various apertures on the shaft.

The disks are constructional parts which are simply manufactured of, for example, synthetic material. The diameter of the disk preferably corresponds approximately to the inside diameter of the cylindrical container, whereby it is insured that the medium to be foamed must pass through the apertures in the disk, when the stream is directed along the longitudinal direction of the container.

The operating manner of the foaming elements formed as disks is further improved by each disk being curved in the shape of a dish, particularly in its peripheral region. The dish-shaped disks are preferably disposed on the shaft in such a manner, that the concave side faces the stream of foamable material and operating gas mixture supplied thereto. The dish-shaped curvature is advantageous in that the surface area of each disk which comes into contact with the medium to be foamed, is greater than the surface area of a corresponding plane or flat disk. A rotating dish-shaped disk effects an advantageous mixture and provides turbulance, whereas a plane disk may merely cut through the medium to be foamed without effectively mixing the material.

In order to improve turbulance, and consequently the foaming effect, a turbulance-causing element is associated with each disk and carried by the shaft. Such a turbulance-causing element can, for example, be implemented as a paddle wheel, and may, for example, take the shape of a propeller. Such turbulence-causing elements can be secured to the shaft, and can either rotate therewith, or run at a different rotational speed compared to the rotational speed of the apertured disks. However, it is also possible to arrange such turbulance-causing elements so that they are stationary.

For supplying the medium to be foamed and the working gas, for example, compressed air, the device of the present invention includes a supply conduit which branches off outside of the cylindrical container into individual supply conduits which preferably pass through the wall of the container in the region of the respective associated disks as pipe elbows at right angles thereto. These individual supply conduits terminate within the container in a jet-like discharge opening facing the concave side of each dish-shaped disk. The mixture of foam medium and working gas passed into the supply conduit is therefore divided into partial streams, wherein each partial stream passes into the cylindrical container in the region of a respective associated disk. Due to the fact that the individual supply conduits are formed as elbows, the rerouting of the stream effects a premixture and prefoaming by changing a large part of the static pressure of the liquid-gas mixture into dynamic pressure. The jet-like narrow discharge opening results in a discharge stream having high dynamic pressure potential.

For further improvement of the foaming effect, the tubular conduit disposed upstream of the individual supply conduits is designed as a premixture chamber. Statically operating foaming elements are disposed in the premixture chamber. Such statically operating foaming elements may, for example, be known filling elements, baffles or the like.

The foam manufactured in the cylindrical container exits from the container through a slit-like opening formed on its underside which is provided with a closure member operating in dependence on the prevailing system pressure.

The closure member ensures a complete sealing of the slit-like opening during standstill of the apparatus, if there is no supply of operating gas or liquid medium. Only when a predetermined pressure has been attained during production of foam does the closure member open. As a closure member, there are provided on the opening rim of the slit-opening, lip elements pressing against one another. This implementation of the closure member has the advantage, that a uniform sealing extending over the entire length of the slit opening is possible with a simple construction. The lip elements are preferably manufactured of elastic material, wherein the opening pressure can be preset depending on the form and rigidity of the lip elements. During standstill of the apparatus, the lip elements are pressed towards one another due to their own elasticity, and only upon a predetermined pressure being attained are the lip elements separated from one another by the pressure of the foam.

In a preferred embodiment, at least one lip element is implemented as a hinged flap hinged to the opening rim and is in effective connection with a positioning member. This embodiment permits, for example, the manufacture of the flap in effective connection with a positioning member of sheet metal or any other material not easily prone to wear, onto which an associated lip element of elastic material abuts. Of course, also two flaps manufactured of metal, and which have the form of lips, can be used.

A spring mechanism can be provided, for example, as a positioning member. By this means, the preset opening pressure can be easily and advantageously set. But also pressure-controlled positioning systems are possible. Thus, for example, an elastic element, or a hinged flap replacing a lip element can be impacted on by pressure-controlled means and kept sealed. In a simple implementation of such pressure-control means, it is, for example, possible to provide a hose abutting a flap or lip element, which expands on being impacted by the compressed air, and which causes the lip elements or flaps to be pressed to one another at a predetermined pressure.

If the above-described mechanism is disposed above the track of a flat structure to be coated, coating can be accomplished by the foam being discharged from the slit-like opening. For trouble-free coating operation, it must be aligned as accurately as possible above the track-shaped material to be coated. The required precise settings and adjustments can be facilitated by a channel element disposed on the slit-like opening and leading to the coating region. This feature has the advantage, that the entire mechanism need not be moved for setting and adjustment, but only the channel element. The channel element may be a constructively simple part, such as a flat hose of flexible material, on whose free end there is disposed a box-shaped discharge part. This version also has the advantage that the channel element can have the function of a shape-changing slit nozzle due to the predetermined shape or elastic properties of the material employed for the flat hose. This is further supported by controlling members for passage of the foam through the flat hose which is associated with the flat hose. Such a controlling member can, for example, be a squeezing member pressing on the exterior of the flat hose, by means of which the otherwise free cross-sectional area of the flat hose can be narrowed. Consequently, through the exit part of the channel element, the predetermined amount of foam is supplied, as desired for coating the track-shaped material.

The box-shaped exit part may, for example, also consist of relatively stiff plates, which may be made of stainless steel or plastic material. This permits an arrangement of elements, by means of which matching of the exit for the foam to a predetermined width of coating is possible, for example, by the length of the walls of the discharge part bordering the free discharge region being adjustable.

Furthermore, there is disposed on the free discharge end of the discharge portion a pair of lips of elastic material. These lips perform the function of a wiper wherein, independently of the use of the device, the lips are either sealed with respect to the flat material to be coated or predetermine the extent of foam to be applied. Preferably, all constructional parts of the mechanism are disposed in a closed housing, wherein the housing is moveably guided by means of a position arrangement in a carrier frame along a vertical direction. By this means it is possible to adjust the layer thickness of foam material to be coated directly by adjusting the height of the housing.

Furthermore, the apparatus is characterized by including link-up elements for coupling thereto mechanisms which are to be joined thereto for the purpose of increasing the operating width of the apparatus. In this manner it is possible to arrange several devices adjacent one another according to the "modular principle" in the simplest possible manner, and to couple them together, so as to, for example, coat a very wide flat structure in one operation. This is particularly advantageous if the width of the structure to be coated is such that a practical dimensioning of the device itself would not be feasible.

The inventive apparatus can be combined with any coating table of known construction which serves to guide the track-shaped structure to be coated.

Other objects and features of the present invention will become apparent from the following detailed description considered in connection with the accompanying drawings. It is to be understood, however, that the drawings are designed as an illustration only and not as a definition of the limits of the invention.

In the drawings wherein similar reference characters denote similar elements throughout the several views.

Figure 1:
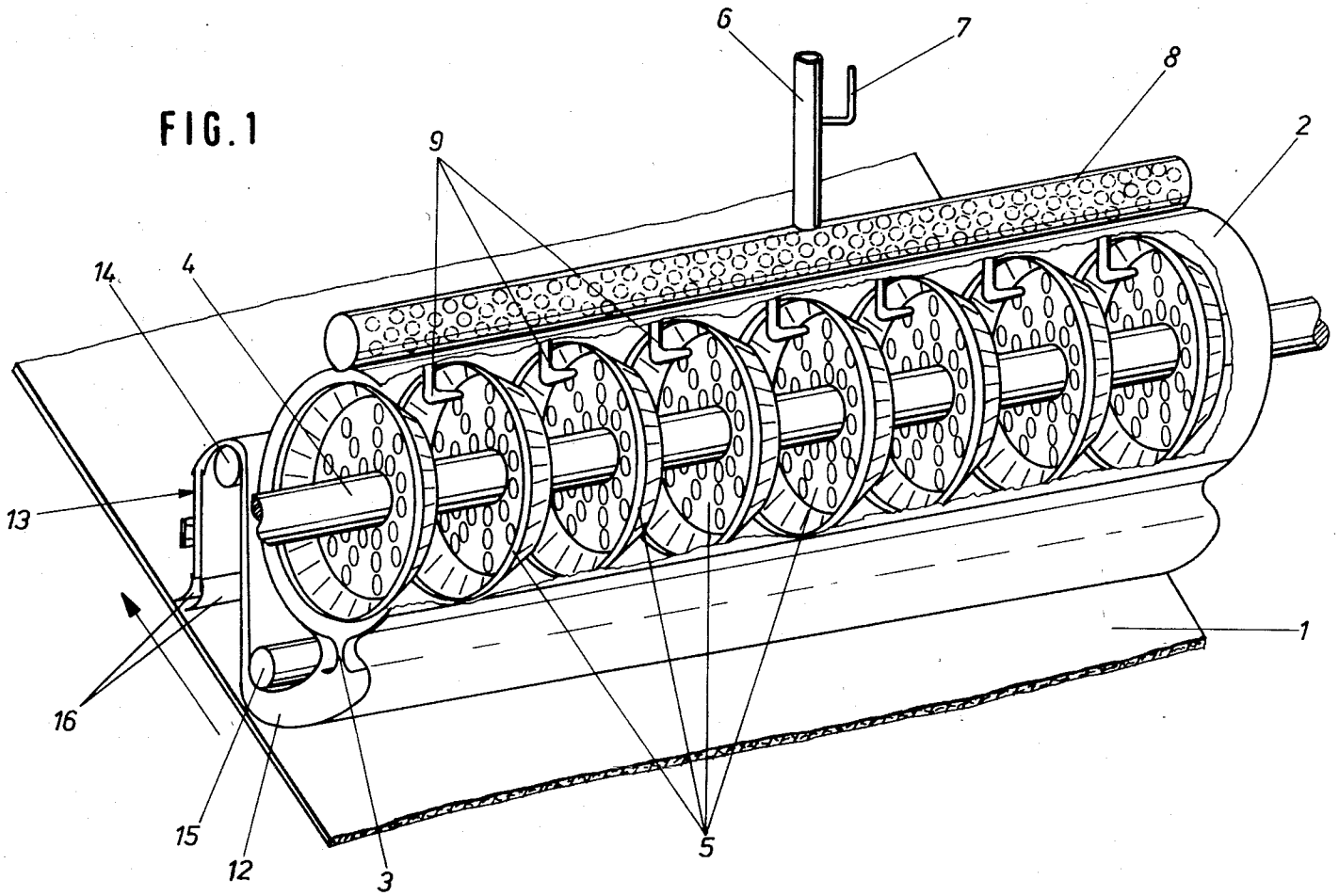
FIG. 1 shows a perspective view of a schematic representation of the apparatus according to the present invention.

Now turning to the drawings, there is shown in FIG. 1 a complete view of the apparatus for coating a flat structure, here shown as a track, designated 1, of textile material. Transversely to the width of track 1 there extends a cylindrical container 2, which is formed with a slit-like opening 3 on a lower side thereof facing the track. The track is moved in the direction of the arrow towards the apparatus. Within cylindrical container 2 there is disposed a shaft 4, on which in turn there are seated along the length thereof uniformly distributed foaming elements, which are here formed as apertured disks 5. On the upper side of container 2, opposite slit-like opening 3, there is disposed a supply conduit 7 for the working gas, for example, compressed air. Compressed air supply conduit 7 communicates exteriorly of cylindrical container 2 with supply conduit 6 for the foamable material, so that mixing takes place at this junction. The end of supply conduit 6 carrying the mixture then communicates with a tubular conduit extending along the length of container 2, but disposed outside the container, which is here implemented as a premixing chamber 8 and which is equipped in a known fashion with statically operating foaming elements. Such statically operating foaming elements may, for example, be known filling elements, such as glass beads, ceramic tubes, various baffles, propeller elements and the like.

From premixing chamber 8, there branches off again individual supply conduits, which are formed as pipe elbows, designated 9, extending from the premixing chamber. These pipe elbows penetrate the wall of cylinder 2 at right angles in the region of a respective associated disk 5, and are formed within cylinder 2 with a bend 10 (see FIG. 3) directed towards an associated disk 5. The individual supply conduits terminate after bend 10 in a jet-like narrowed discharge opening 11.

A channel element, here implemented as a meandering-like shaped flexible flat hose 12, is connected to slip-like opening 3 of cylindrical container 2, and leads to the coating region. At the free end of the channel element there is disposed a rigid box-shaped exit portion 13. Rod-like holding means, denoted by the reference numerals 14 and 15, guide the flat hose therearound, resulting in the meandering shape thereof.

At the free discharge end of exit portion 13 there is disposed a pair of lips 16 of elastic material which function as a wiper.

Figure 2:
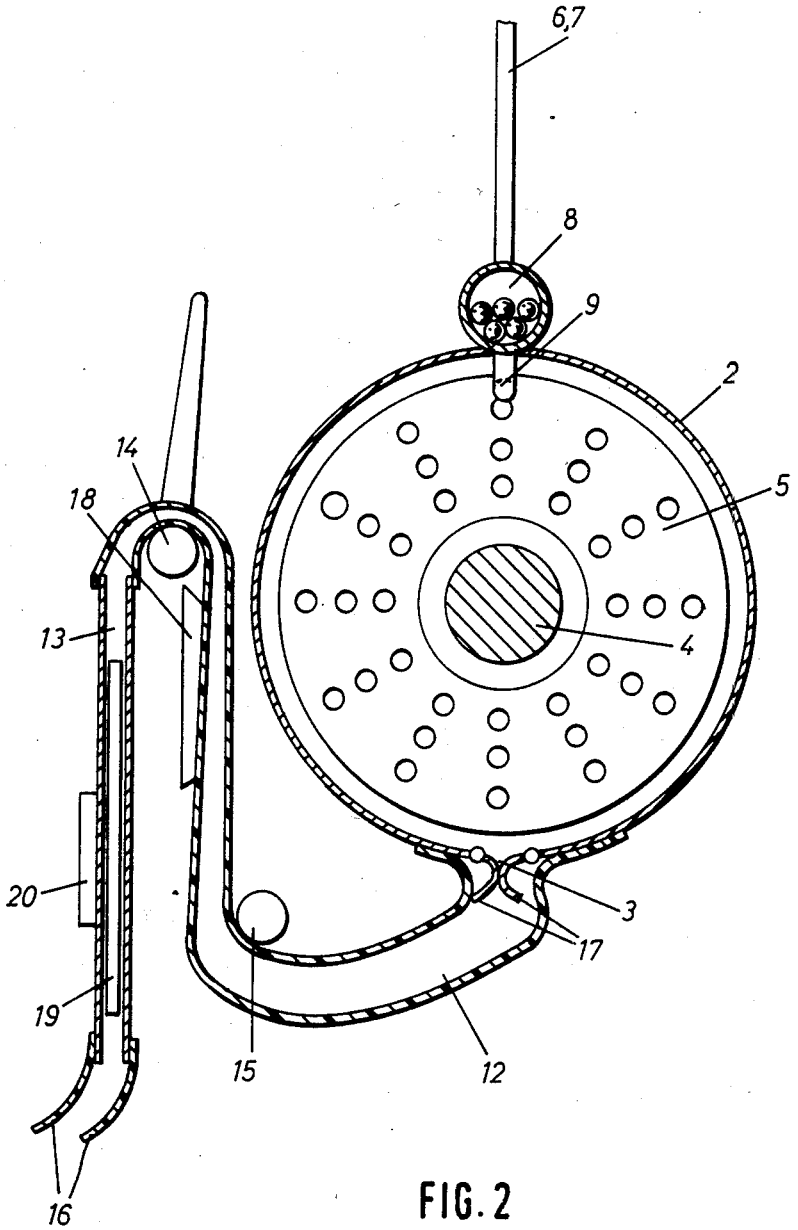
FIG. 2 is a cross-sectional view of the apparatus of FIG. 1.

In FIG. 2, there is shown a schematic side view of the apparatus of FIG. 1 in cross section. Identical construction parts have been denoted with the same reference numerals. From this illustration, one can see that the slit-like opening 3 on the lower side of cylindrical container 2 is provided with a closure member, which operates in dependence of the system pressure prevailing in container 2. The closure member consists in this embodiment of lip elements, of which one each is disposed on each opening rim of slit-opening 3. Each lip element is a flap 17 hingedly connected to a rim of opening 3, and wherein at least one of the flaps is in effective operating connection with a non-illustrated position member, for example, a spring actuator. In the embodiment shown, the meandering shape of the channel element, implemented as flat hose 12, is clearly visible; this element has the function of a variable slit nozzle, due to the flexible material employed therefor. For the purpose of changing the shape of the slit nozzle, a regulating member is associated with the flat hose, which regulating member is implemented here as a squeezing member 18 pressing against the exterior of the flat hose. The squeezing member can, for example, also be implemented as a bar or strip.

Bordering on the free end of flat hose 12 there is a box-shaped exit part 13, for example, made of stainless steel sheets. Walls which border the length of the discharge of exit part 13 are provided, so that they match the width of track 1 to be coated, and are implemented as displaceable sliding members 19, which may be displaced from the exterior through actuating member 20.

Figure 3:
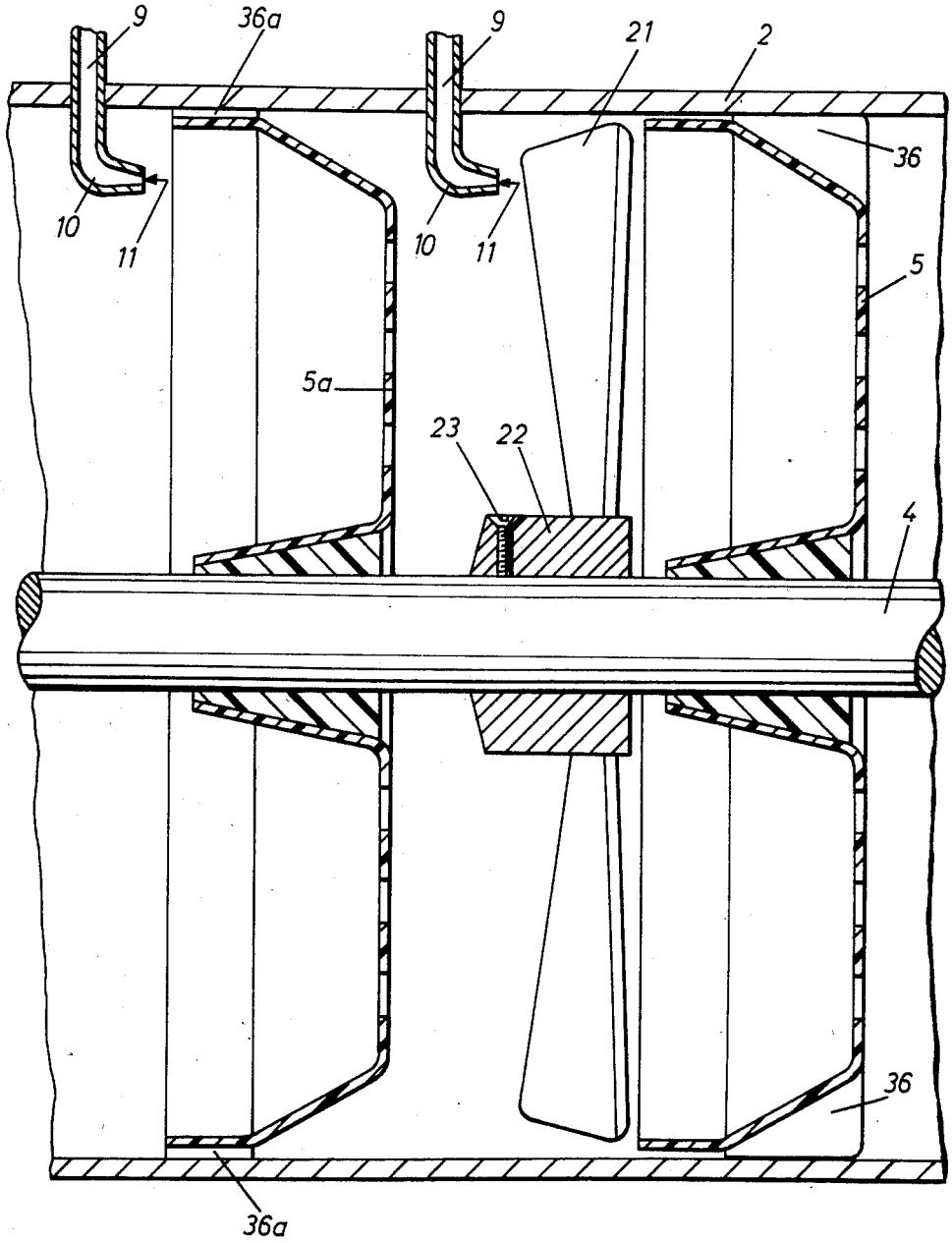
FIG. 3 is an enlarged view of a portion of the cylindrical container of the apparatus of FIG. 1, including the foaming elements, in longitudinal section.

In FIG. 3, a portion of container 2 of the apparatus illustrated according to FIGS. 1 and 2 is shown in longitudinal section, in an enlarged scale.

As has already been described, foaming elements which rotate with the shaft are carried by the shaft, and are formed here as apertured disks 5 or 5*a*. The disks, as shown, are curved in the form of a dish, and may, for example, be made of synthetic material. Each disk has a diameter approximately corresponding to the inside diameter of container 2. The outer periphery of the disks may be equipped with strip-off devices grazing the interior wall of the container. Disks 5 and 5*a* differ from one another by the arrangement of such strip-off devices 36 and 36*a*.

All disks are secured to shaft 4, so that their respective concave dish-shaped curvatures face the jet-like discharge openings 11 of pipe elbows 9. In front of the open side of the dish-shaped disk 5 in this embodiment there is additionally disposed a turbulance-causing element, implemented here as a multi-winged propeller 21, which is freely rotatable with respect to shaft 4, or is secured to the shaft by means of screw 23, having a recessed head, passing through propeller hub 22.

Figure 4:
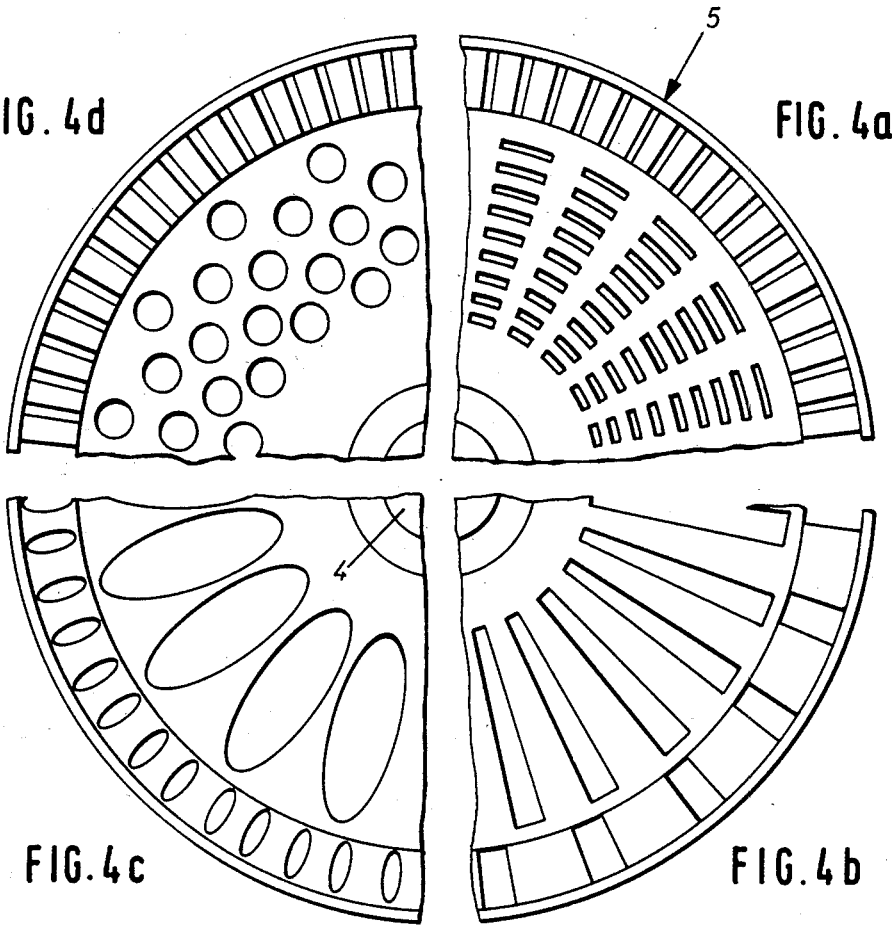
FIG. 4 is an enlarged plan view of a foaming element showing several versions of the aperture formations.

In FIG. 4 there is shown a schematic plan view of an apertured disk 5, which is secured to shaft 4. FIG. 4 has been subdivided by the geometric axes into four quadrants, each showing a different embodiment of the apertures.

Figure 5:
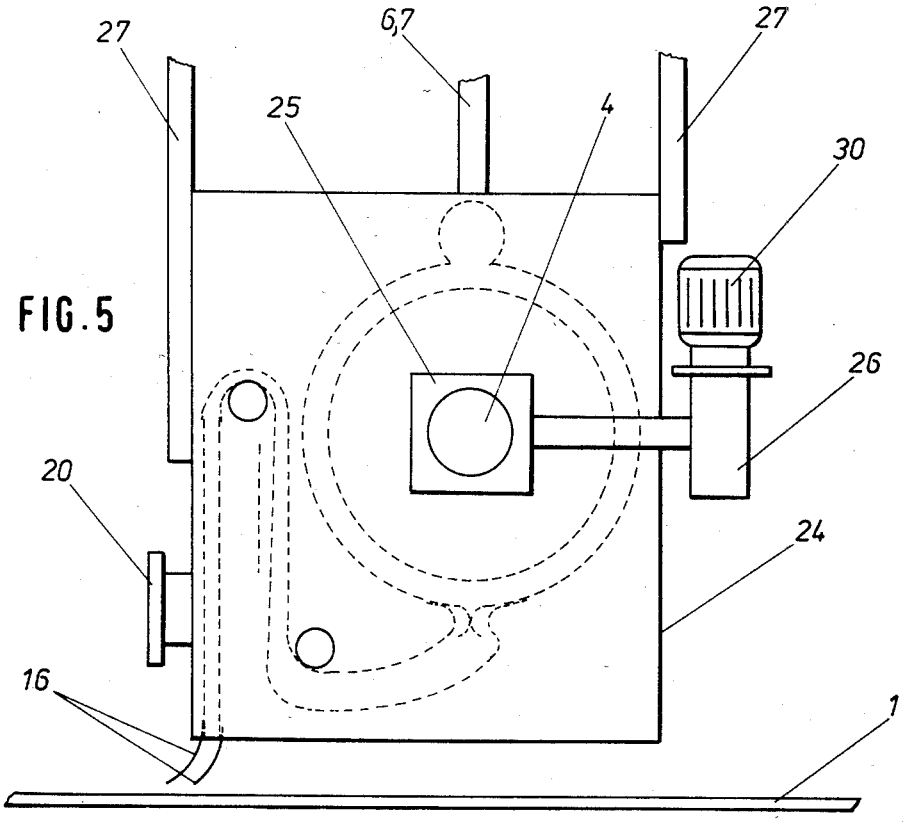
FIG. 5 is a schematic side view of the apparatus, inclusive of a housing receiving all constructional parts.

In FIG. 5, a side elevational view of the device has been shown schematically, wherein all construction parts are disposed in a closed housing 24. Identical construction parts have been denoted with same reference numerals. The housing carries on its front part a drive element for shaft 4, which consists here of two bevel drives 25 and 26, and wherein bevel drive 26 is flanged onto an electric motor 30. Furthermore, the housing includes rails 27 secured to the outside thereof, which make it possible to displaceably guide the entire apparatus within a non-illustrated machine frame in a vertical direction, as a result of which the thickness of the foam, which is to be applied onto track 1, can be adjusted and changed.

Figure 6:
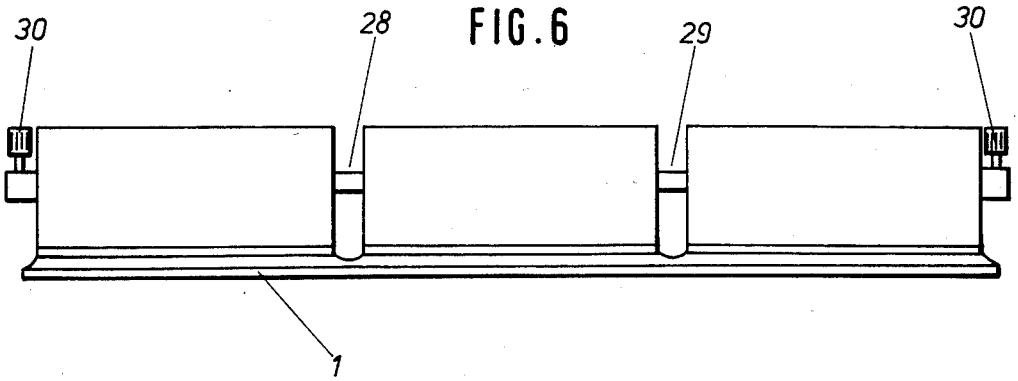
FIG. 6 is a schematic representation of a plurality of devices adjoining one another and coupled together.

In FIG. 6, there is shown a schematic embodiment in which three devices adjoin one another. Shafts 4 of the devices can be connected to one another by couplings disposed in respective regions 28 and 29. This arrangement permits a coating of any excessively wide track 1 with foam. In this embodiment, the outer front sides of the respective outer devices each include an electric motor 30.

While several embodiments of the present invention have been shown and described, it will be obvious that many changes and modifications may be made thereto without departing from the spirit and scope of the present invention.

What is claimed is:

1. An apparatus for applying a continuously manufactured foam made of a mixture of foamable material and operating gas to a flat structure to be coated thereby, comprising:

a generally cylindrical container for the manufactured foam disposable directly above the flat structure, said container having a lower side facing the structure which is provided with a rim defining a slit-like opening for the discharge of said foam, the length of said slit-like opening corresponding to the desired coating width;

a plurality of supply conduits communicating with said container for passing therethrough a mixture comprising a foamable material and operating gas;

a plurality of mechanically-operating foaming elements mounted in said container for producing foam therein from said mixture of foamable material and operating gas, each of said foaming elements each including an apertured disk having a plurality of openings formed therethrough and having an arcuate dish-like form, at least in its outer peripheral region; and a concentrically disposed drive shaft rotatably mounted in said cylindrical container and on which said foaming elements are disposed for rotation therewith.

2. The apparatus according to claim 1, further comprising a turbulance-causing element associated with each said disk and carried by said shaft.

3. The apparatus according to claim 2, wherein each turbulance-causing element is formed as a paddle wheel.

4. The apparatus according to claim 1, further comprising a tubular conduit, disposed exterior to said cylindrical container, and serving as a premixing chamber, and a plurality of statically operating foaming elements disposed in said tubular conduit and wherein said supply conduits each comprise an elbow conduit branching off from said tubular conduit and passing through the wall of said container in the region of said disk respectively associated therewith, said elbow conduit including a leg directed toward a concave curvature of said disk, the free end of which includes a jet-like discharge opening.

5. The apparatus according to claim 1, further comprising a closure member for said slit-like opening of said container operating in dependence on the system pressure within said container, said closure member including lip elements which are disposable on said rim of said slit-like opening with said lip elements normally passing against one another, at least one of the lip elements being formed as a flap hingeably connected to the opening rim operatively connected to a positioning member.

6. The apparatus according to claim 5, further comprising a channel element communicating with said slit-like opening and leading to a coating region, said channel member comprising a flat hose of flexible material on the free end of which there is disposed a box-shaped exit part having a free discharge end, and at least one regulating element associated with the flat hose for foam throughout control.

7. The apparatus according to claim 6, wherein the walls of said box-shaped exit part bordering the length of the free end of the flat hose includes displaceable sliders, and a pair of lips of elastic material disposed on the free discharge end of the box-like exit part.

8. The apparatus according to claim 1, further comprising a housing receiving all parts of the apparatus and a carrier frame, said housing being mounted for vertically-displaceable movement on said carrier frame, and said housing including connecting elements for coupling several said housings together in a row for the purpose of increasing the effective operating width of said apparatus.

9. An apparatus for applying a continuously manufactured foam made of a mixture of foamable material and operating gas to a flat structure to be coated thereby, comprising:

a generally cylindrical container for the manufactured foam disposable directly above the flat structure, said container having a lower side facing the structure which is provided with a slit-like opening for the discharge of said foam, the length of said slit-like opening corresponding to the desired coating width;

a plurality of mechanically-operating foaming elements mounted in said container for producing foam therein from the mixture of foamable material and operating gas, said mechanically-operating foaming elements each including a concavely-shaped apertured disk having a plurality of openings formed therethrough;

a concentrically disposed drive shaft rotatably mounted in said cylindrical container and on which said mechanically-operating foaming elements are disposed for rotation therewith;

a tubular conduit, disposed exterior to said cylindrical container and serving as a premixing chamber;

a plurality of statically operating foaming elements disposed in said tubular conduit; and a plurality of supply conduits communicating with said container for passing therethrough the mixture, said supply conduits each including an elbow conduit branching off from said tubular conduit and passing through the wall of said container in the region of said disk respectively associated therewith, said elbow conduit including a leg directed toward the concave curvature of said disk, the free end of which includes a jet-like discharge opening.

10. The apparatus according to claim 9, wherein each said disk has an arcuate dish-like form, at least in its outer peripheral region.

11. The apparatus according to claim 9, further comprising a turbulance-causing element associated with each said disk and carried by said shaft.

12. The apparatus according to claim 11, wherein each tutbulance-causing element is formed as a paddle wheel.

13. The apparatus according to claim 9, further comprising a closure member for said slit-like opening of said container operating in dependence on the system pressure within said container, said closure member including lip elements which are disposable on said rim of said slit-like opening with said lip elements normally pressing against one another, at least one of the lip elements being formed as a flap hingeably connected to the opening rim operatively connected to a positioning member.

14. The apparatus according to claim 13, further comprising a channel element communicating with said slit-like opening and leading to a coating region, said channel element comprising a flat hose of flexible material on the free end of which there is disposed a box-shaped exit part having a free discharge end, and at least one regulating element associated with the flat hose for foam throughput control.

15. The apparatus according to claim 14, wherein the walls of said box-shaped exit part bordering the length of the free end of the flat hose includes displaceable sliders, and a pair of lips of elastic material disposed on the free discharge end of the box-like exit part.

16. The apparatus according to claim 9, further comprising a housing receiving all parts of the apparatus and a carrier frame, said housing being mounted for vertically-displaceable movement on said carrier frame therefor, and said housing including connecting elements for coupling several said housings together in a row for the purpose of increasing the effective operating width of said apparatus.

17. An apparatus for applying a continuously manufactured foam made of a mixture of foamable material and operating gas to a flat structure to be coated thereby, comprising:

a generally cylindrical container for the manufactured foam disposable directly above the flat structure so that said container having a lower side facing the structure which is provided with a rim defining a slit-like opening for the discharge of said foam, the length of said slit-like opening corresponding to the desired coating width;

a closure member for said slit-like opening of said container operating in dependence on the system pressure within said container, said closure member including lip elements which are disposable on said rim of said slit-like opening with said lip elements normally pressing against one another, at least one of said lip elements being formed as a flap hingeably connected to a rim of said opening and being operatively connected to a positioning member;

a plurality of supply conduits communicating with said container for passing therethrough a mixture comprising a foamable material and operating gas; and a plurality of mechanically operating foaming elements in said container for producing foam therein from said mixture of foamable material and operating gas.

18. The apparatus according to claim 17, further comprising a concentrically disposed drive shaft rotatably mounted in said cylindrical container and on which said foaming elements are disposable, and each said foaming element comprises an apertured disk rotating with said shaft having a plurality of openings formed therethrough.

19. The apparatus according to claim 18, wherein each said disk has an arcuate dish-like form, at least in its outer peripheral region.

20. The apparatus according to claim 19, which further comprises a tubular conduit disposed exterior to said cylindrical container and wherein each supply conduit comprises an elbow conduit branching off from said tubular conduit and passing through the wall of said container in a region of said disk respectively associated therewith, said elbow conduit including a leg directed toward the concave curvature of said disk, the free end of which includes a jet-like discharge opening, and wherein said tubular conduit is a premixing chamber in which are disposed statically operating foaming elements.

21. The apparatus according to claim 18, further comprising a turbulance-causing element associated with each said disk and carried by said shaft.

22. The apparatus according to claim 21, wherein each turbulance-causing element is formed as a paddle wheel.

23. The apparatus according to claim 17, further comprising a channel element communicating with said slit-like opening and leading to a coating region, said channel element comprising a flat hose of flexible material on the free end of which there is disposed a box-shaped exit part having a free discharge end, and at least one regulating element associated with the flat hose for foam throughput control.

24. The apparatus according to claim 23, wherein the walls of said box-shaped exit part bordering the length of the free end of the flat hose includes displaceable sliders, and a pair of lips of elastic material disposed on the free discharge end of the box-like exit part.

25. The apparatus according to claim 17, further comprising a housing receiving all parts of the apparatus and a carrier frame, said housing being mounted for vertically-displaceable movement on said carrier frame, and said housing including connecting elements for coupling several said housings together in a row for the purpose of increasing the effective operating width of said apparatus.

* * * * *